US005427241A

United States Patent [19]

Sutherland

[11] Patent Number: 5,427,241

[45] Date of Patent: Jun. 27, 1995

[54] ROUNDED BOTTOM ENCLOSED CARRIER

[75] Inventor: Robert L. Sutherland, Kennesaw, Ga.

[73] Assignee: Riverwood International Corporation, Atlanta, Ga.

[21] Appl. No.: 213,492

[22] Filed: Mar. 15, 1994

[51] Int. Cl.[6] ..... B65D 75/00

[52] U.S. Cl. ..... 206/427; 206/141; 206/434

[58] Field of Search ..... 206/141, 147, 162, 427, 206/428, 431, 434

[56] References Cited

U.S. PATENT DOCUMENTS

| | | | |
|---|---|---|---|
| 4,394,903 | 7/1983 | Bakx | 206/427 |
| 4,440,340 | 4/1984 | Bakx | 206/427 |
| 4,588,084 | 5/1986 | Holley, Jr. | 206/427 |
| 4,744,507 | 5/1988 | Morsbach | 206/427 |
| 4,919,266 | 4/1990 | McIntosh, Jr. et al. | 206/427 |
| 5,197,598 | 3/1993 | Stout et al. | 206/141 |
| 5,221,041 | 6/1993 | Stout et al. | 205/141 |
| 5,246,112 | 9/1993 | Stout et al. | 206/147 |

*Primary Examiner*—David T. Fidei

[57] ABSTRACT

A carrier having an end panel construction that snaps into place during formation of the carrier and has the ability to follow the contour of adjacent curved or beveled packaged articles. Gusset tabs foldably connected to the lower end panel flap and adjacent lower glue flaps cause the flaps to snap into place. The lower glue flaps are continuations of the lower portion of the side panels and follow the contour of adjacent curved packaged articles. Bevel panels between the lower glue flaps and the top panel enable the carrier to fit tightly about the upper tapered portions of the corner articles in the carrier.

22 Claims, 3 Drawing Sheets

ROUNDED BOTTOM ENCLOSED CARRIER

FIELD OF THE INVENTION

This invention relates to enclosed sleeve-type article carriers. More particularly, it relates to a construction which facilitates closing the end glue flaps of the carrier and enables the corner area between the side and end panels to better conform to the contour of adjacent packaged articles.

BACKGROUND OF THE INVENTION

When forming a fully enclosed carrier such as one used to package long neck bottles, the upper portions of the end panels are often tapered so as to better follow the contour of adjacent bottles. To accomplish this the bottom panel is made longer than the top panel and the side panels are made longer at the bottom than at the top. The lower portion of the side panels is of constant length and the upper portion is tapered. Although such a carrier conforms to the shape of the bottles better than a nontapered carrier, there are still gaps between the bottles and the corners of the carrier. Further, there is often a relatively large space between the upper portion of the side panels and the bottle necks.

While it would be desirable to more tightly fit long neck bottles in an enclosed carrier, the nature of sleeve-type carriers, which are conventionally used to package the bottles, has prevented it. Sleeve-type carriers are formed from a blank which is delivered to a packaging machine in the form of a collapsed sleeve. After the sleeve is erected, bottles are loaded through one or both open ends of the sleeve and the ends of the carrier are closed. The end panels of the carrier are formed by folding in dust or glue flaps from the side panels to which they are connected, and then gluing upper and lower end panel flaps to them. This arrangement results in the undesirable corner gaps.

The glue flaps hinged to the end edges of the side panels are basically comprised of a single flap containing a wide notch extending in from the outer edge of the flap to a point near the juncture of the tapered upper edge of the side panel and the straight lower edge portion. This creates a narrow connecting strip between the upper and lower segments of the glue flap. The combination of the notch and a score line in the connecting strip allows the two segments of the glue flaps to shift as necessary when folded into place in order to accommodate the segments to the tapered shape of the end panels. Because folding of the upper segment of the glue flaps is resisted by the angled relationship of its fold line to the fold line of the lower segment, folding of the glue flaps can be difficult.

It would be desirable to be able to form a tapered carrier which is capable of more closely following the contours of long neck bottles or other tapered articles in order to more tightly hold the articles within the package. The goal is to not only provide end panels which more closely conform to the shape of the bottles, but to actually contact the bottles in the corner areas. In addition, it would be desirable for the side panels of the carrier to more closely follow the contour of adjacent bottles. It is therefore an object of the invention to provide a sleeve-type carrier which is capable of forming a tighter package of long neck bottles or other tapered articles.

BRIEF SUMMARY OF THE INVENTION

The carrier of the invention is particularly adapted to package articles having lower curved portions and upper narrower portions. The basic structure of the carrier is similar, to a point, to conventional designs in that top and bottom panels are connected to side panels along fold lines to form a sleeve configuration, with end panels being comprised of overlapping upper and lower end panel flaps connected by fold lines to the top and bottom panels. According to the invention, however, instead of the end panel flaps being adhered to conventional glue flaps extending from the side panels, dual glue flaps consisting of upper and lower flap portions are provided. The upper glue flaps are foldably connected to the side panels while the lower glue flaps are an integral extension of the side panel. Each lower end panel flap is connected on either side to the adjacent lower glue flap by a gusset tab, and portions of the lower glue flaps are curved about the lower curved portions of adjacent articles in the carrier.

A bevel panel may be provided between each upper glue flap and the associated side panel, connected by a fold line to the side panel and a fold line to the upper glue flap. The bevel panel is adapted to tightly fit about the upper tapered portion of the corner articles. The carrier is further made to conform to the shape of tapered articles by short sloped portions at the top of the side panels and outwardly tapering side and end panels.

Cutouts in the glue flaps and adjacent slits in the side panels allow a smooth transition between the curving of the lower glue flaps and the folding of the upper glue flaps and bevel panels. As explained in detail below, the gusset connection between the lower glue flaps and the lower end panel flaps causes both the upper and lower glue flaps to automatically close upon the lower end flap being pivoted down from its initial position prior to loading articles into the carrier sleeve.

The carrier design not only permits the corner areas of the carrier to better conform to the shape of the adjacent bottles or other similarly shaped articles, but also facilitates fabrication of the carrier from a unitary blank. These and other aspects and benefits of the invention will readily be apparent from the more detailed description of the preferred embodiments of the invention which follows.

DETAILED DESCRIPTION OF THE PREFERRED EMBODIMENTS

Figure 1:
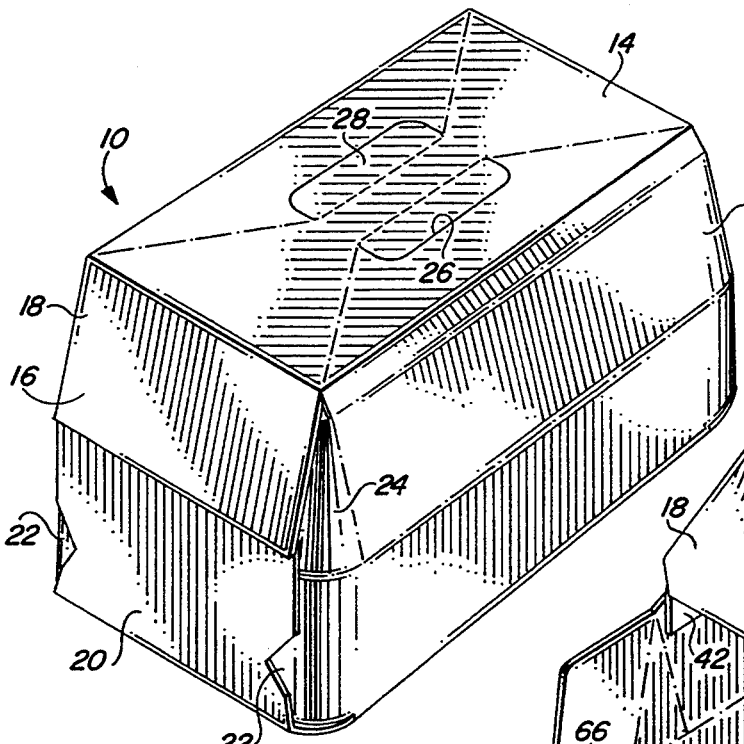
FIG. 1 is a pictorial view of the carrier of the invention.

Referring to FIG. 1, a carrier 10 includes side panels 12 connected to top panel 14 and to a bottom panel, not visible in this view. The carrier includes end panels 16 comprised of upper and lower end panel flaps 18 and 20 overlying upper and lower glue flaps which extend transversely from the side panels 12. A portion of the lower glue flap 22 can be seen through the notch in the lower end flap 20. The upper glue flap is hidden in this view by the upper end flap 18. Bevel panels 24 connect the upper glue flaps to the side panels 12. The lower glue flaps, however, comprise a continuous extension of the side panels. Because the connection between the side panels and the lower glue flaps is unbroken, the lower end corner area of the carrier is able to conform to the contour of the cylindrical barrel of an adjacent bottle, while the tapered end panels and the bevel panels extend in to the bottle necks. Handle openings 26, which are covered by a hinged flap 28, are provided in the top panel in order to lift and carry the carrier.

Figure 2:
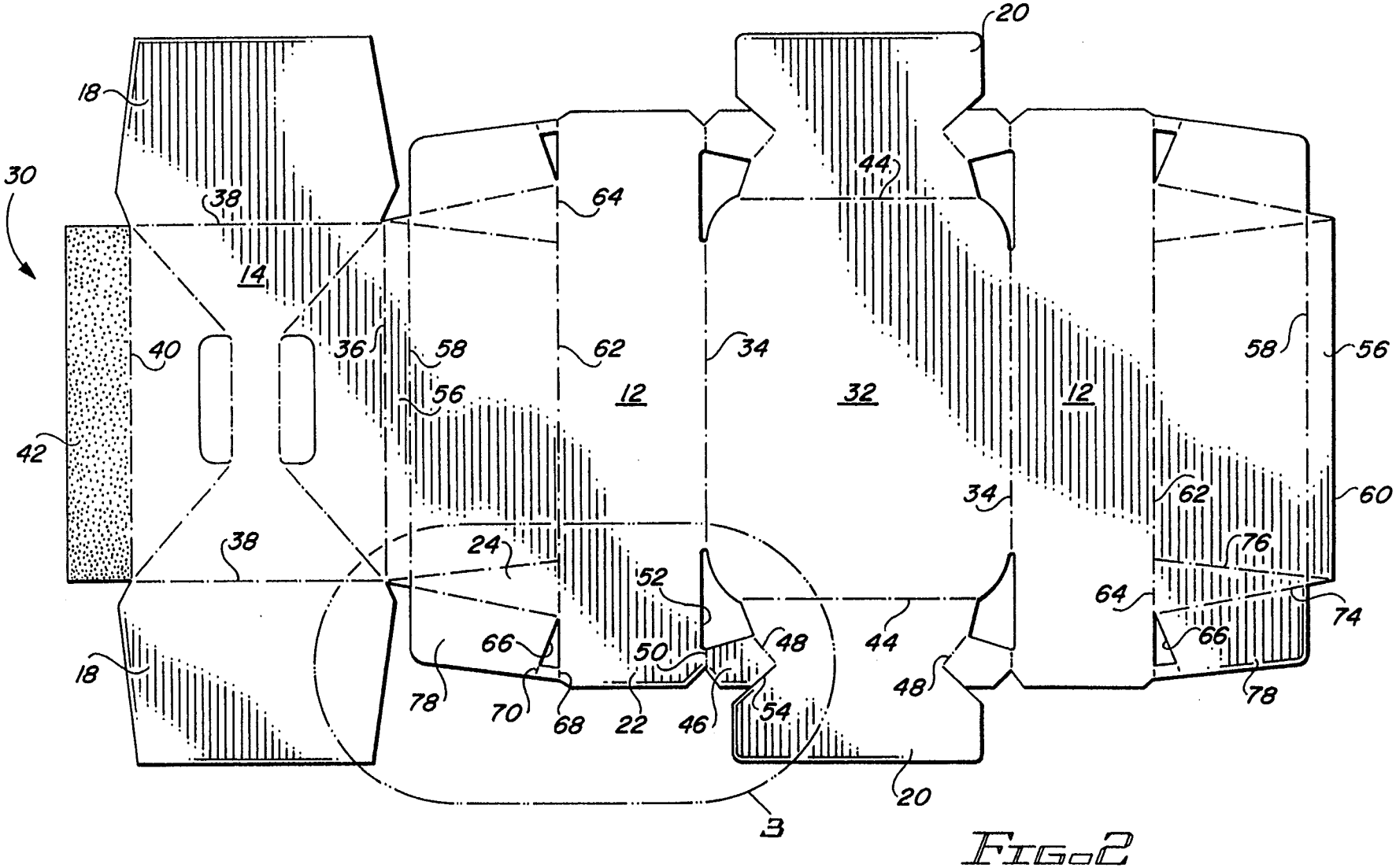
FIG. 2 is a plan view of a blank used to form the carrier.

The carrier is formed from the blank 30 shown in FIG. 2, wherein like reference numerals to those used in FIG. 1 refer to similar elements. The blank is comprised of flexible sheet material of suitable strength, such as paperboard of conventional carrier thickness, divided into various sections. A bottom panel section 32 is connected to the side panel sections 12 by fold lines 34, and a top panel section 14 is connected to the interior side panel section by fold line 36. Connected to the end edges of the top panel section along fold lines 38 are the upper end panel flaps 18, and connected to the outer side edge of the top panel section along fold line 40 is a glue flap 42. The lower end panel flaps 20, which are adapted to overlap the upper end panel flaps in a carrier, are connected to the end edges of the bottom panel section along fold lines 44.

Figure 3:
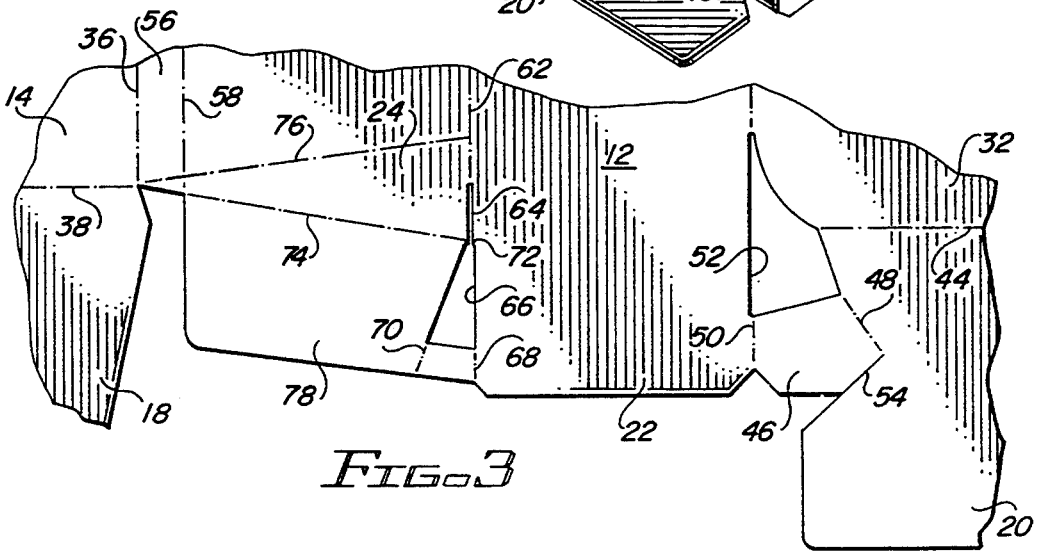
FIG. 3 is an enlarged view of the portion enclosed by the oval 3 of FIG. 2.

Referring to FIG. 3 as well as FIG. 2, the lower end panel flaps 20 are connected to the adjacent side panel sections 12 by a gusset panel or tab 46. The tabs 46 are connected to the lower end panel flaps 20 along fold lines 48 located between the fold line 44 and the end of the lower end panel flap 20, and to the side panel sections 12 at the end portion of the side panel section along fold line 50. The tab fold lines 50 are substantially aligned with the fold lines 34, while the tab fold lines 48 are angled so that, if extended, they would form an acute angle with extensions of the fold lines 44. The configurations of the tabs 46, the lower end panel flaps 20, the bottom panel section 32 and the side panel sections 12 are such that cutouts 52 are defined by spaced edge portions of these elements, which is made possible by the fact that the fold line 44 is shorter than the width of the bottom panel section 32. Preferably, the corners of the bottom panel section, which form an edge of the cutouts 52, are rounded to provide a curved bottom panel. Because the tab fold lines 48 are inwardly spaced from the side edges of the lower end panel flap 20, the lower edge of the tabs 46 extending from the fold line 48 is formed by slits 54 in the lower end panel flap. If the side edge of the lower end panel flap extended directly from the inner end of the tab fold line 48, there would, of course, be no need for the slits 54.

The interior side panel section 12 includes a short panel section 56 bounded by the fold lines 36 and 58. The side panel section at the end of the blank includes a similar short panel section, but in this case the short panel section is defined by the fold line 58 and the end edge 60 of the blank. In a carrier fabricated from the blank the short panel sections form sloped side panel portions extending out from the top panel. A score line 62, which extends parallel to and is located between the fold lines 34 and 58, terminates at a pair of aligned slits 64. The slits terminate at a triangular cutout 66 spaced a short distance from the end of the side panel sections. Score lines 68 and 70 connect the cutouts to the end edges of the side panel sections. Extending from the intersection 72 of the slit 64 and the cutout 66 to the intersection of the fold lines 36 and 38 is a fold line 74. Another fold line 76 extends from the latter intersection to a point on the fold line 62 spaced a short distance from the interior end of the slit 64. Both fold lines are angled with respect to the fold line 38. The area between the fold lines 74 and 76 and a line connecting the intersection point 72 and the intersection between the fold lines 76 and 62 comprises the bevel panel 24, while the area between the fold line 74, the combined cutout 66 and score line 68 and the panel edges comprises an upper glue flap 78. The lower portion of the side panels beneath the cutout 66 comprises the lower glue flap 22.

It can be seen that the width of the top panel section, as measured between the fold lines 36 and 40, is less than the width of the bottom panel section, as measured between the fold lines 34, causing the side panels to angle out toward the score lines 62. Also, the length of the top panel section, as measured between the fold lines 38, is less than the length of the bottom panel section, as measured between the fold lines 44, causing the end panels to angle out to approximately the lower edge of the upper glue flaps.

Figure 4:
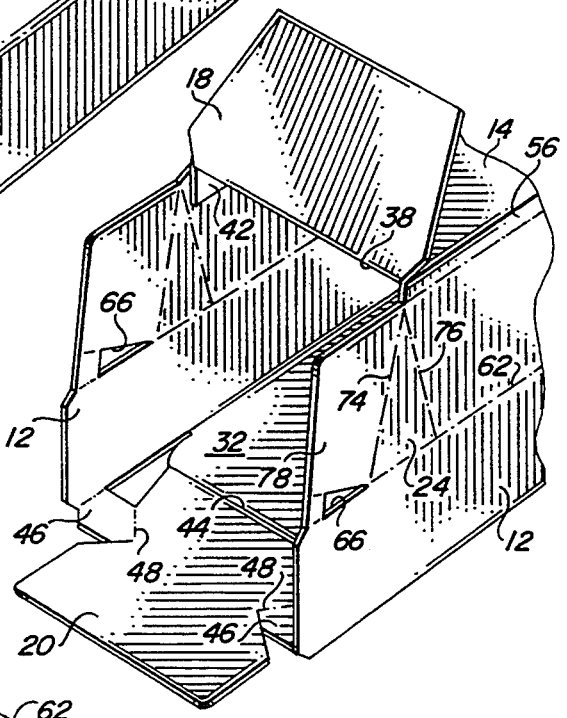
FIG. 4 is a pictorial view of an open end of a carrier sleeve in condition to be loaded with articles.

To form a carrier from the blank, the blank is folded about the inner fold line 58 and the outer fold line 34 so that the end of the blank at the right of FIG. 2 overlies the glue flap 42 and terminates at the glue flap fold line 40. Adhesive on the glue flap, illustrated by stippling, adheres the overlapped ends of the blank together. This produces a collapsed sleeve, which is subsequently introduced to a packaging machine where the sleeve is squared up and erected in a manner well known in the art. The resulting erected sleeve is illustrated in FIG. 4, wherein the lower end panel flap 20 is substantially an outward extension of the bottom panel 32, and the upper glue flaps 78, the bevel panels 24 and the lower glue flap areas 22 are extensions of the side panels 12. The upper end panel flap 18 typically is folded up at this point so as not to interfere with the introduction of the articles to be packaged.

Figure 5:
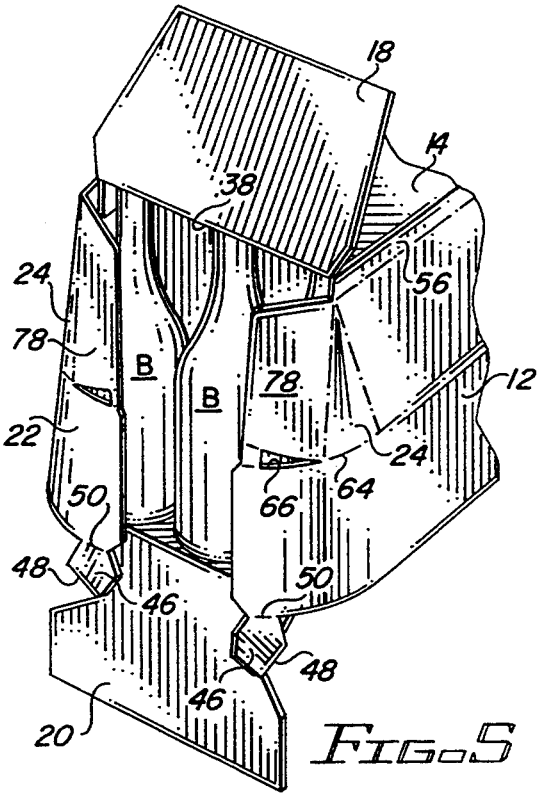
FIG. 5 is a pictorial view of the open end of the carrier sleeve of FIG. 4, with the lower end panel flap shown in vertically lowered position and the glue flaps in partially closed position.
Figure 6:
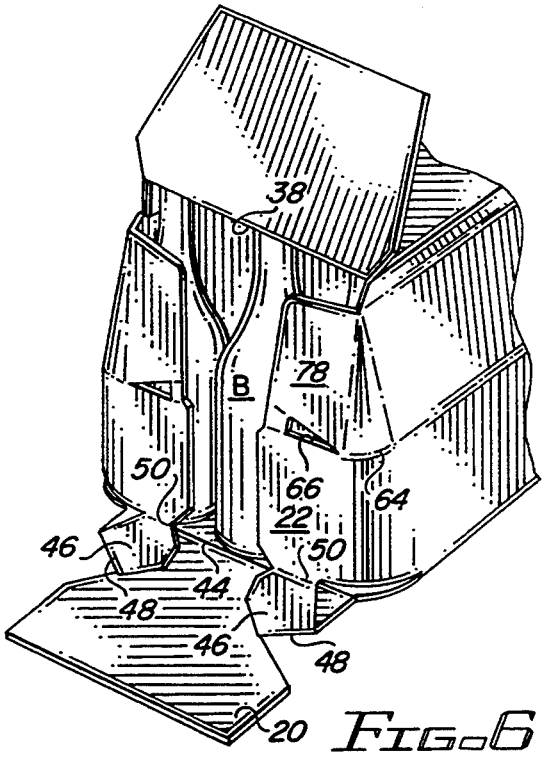
FIG. 6 is a pictorial view of the open end of the carrier sleeve of FIG. 4, with the end panel flap shown in interim horizontal position in the course of being moved into final closed position.

As illustrated in FIG. 5, after the articles, such as the long neck bottles B, have been loaded through the open ends, the end panels are formed by first pivoting the lower end panel flap 20 down about the fold line 44 so that the lower end panel flap forms substantially a right angle with the bottom panel 32. Downward movement of the lower end panel flap 20 causes the gusset tabs 46 to fold up about their fold lines 48, which in turn causes the upper glue flaps 78 and the bevel panels 24 to pivot inwardly as a unit about the bevel panel fold lines 76 to a position somewhat short of their fully closed position. At the same time, the side panel extensions which form the lower glue flap areas 22 are pulled around the barrel portions of the corner bottles. This movement of the glue flaps brings the fold lines 50 of the gusset tabs 46 into substantially horizontal position, so that when the lower end panel flap 20 is subsequently pivoted back up into its original open position, as shown in FIG. 6, the tabs 46 fold up about the fold lines 50. This causes the upper glue flaps 78, their connected bevel panels 24 and the lower glue flap areas 22 to move to their final closed position. It will be understood that the biases created at the fold lines 48 and 50 by this folding action result in the gusset tabs and glue flaps being essentially locked into place.

The final step in closing the ends of the carrier in order to produce the package of FIG. 1 is to fold the upper end flaps 18 down about their fold lines 38 and the lower end panel flaps 20 up about their fold lines 44 to adhere them to the glue flaps and to each other in their overlapping areas by adhesive applied to the upper and lower end panel flaps. The adhesive will preferably be applied to the gusset tabs as well, to adhere both the tabs and the lower end panel flaps directly to the glue flaps. As can be seen from FIG. 6, the tabs 46 in the final carrier configuration will lie directly between the lower end panel flap 20 and the lower glue flaps 22 in face-to-face relationship with both. Either the upper or the lower end panel flap may overlap the other, although it is preferred that the lower flap overlap the upper so that there are no exposed edges on the end panels to interfere with loading the carriers into a packing tray.

Figure 7:
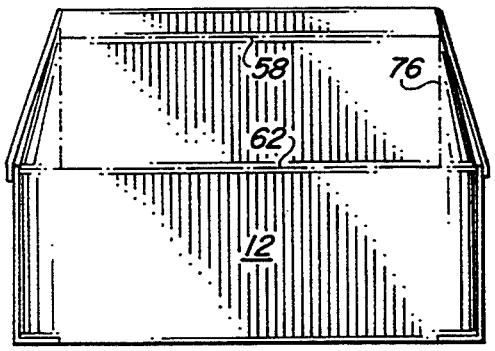
FIG. 7 is a side elevation of the carrier.
Figure 8:
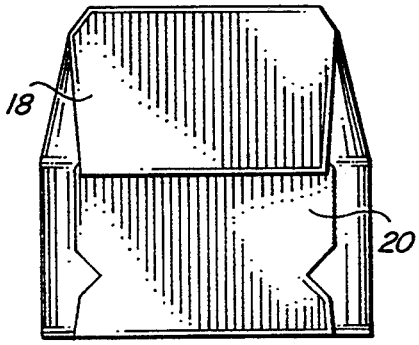
FIG. 8 is an end elevation of the carrier.

The angled fold lines 74 and 76 connecting the bevel panels 24 to the upper glue flaps 78 and the side panels 12, respectively, permit the bevel panels to flex around the curved contours of adjacent bottles and to contact the bottles at an angle designed to engage both the shoulder of the bottles and the top portion of the bottle necks. The lower glue flaps 22 curve about the outer barrel portions of adjacent corner bottles, extending upward at substantially right angles to the bottom panel. Since the lower end panel flaps are adhered to the lower glue flaps 22, they also are substantially at right angles to the bottom panel, while the upper end panel flaps, being adhered to the angled glue flaps 78, lie at a slight outward angle to the top panel. The upper portion of the end panels is thus at an angle generally corresponding to the slope of the bottles from the top of the barrel portion to the top of the bottle neck, and the lower portion of the end panels is substantially perpendicular, as is the barrel portion of the bottles. This is in keeping with the fact that the length of the top panel is slightly less than the length of the bottom panel. These relationships are illustrated further in FIG. 6. In addition, the upper portion of the side panels tapers slightly outwardly down to the score line 62 in the side panels, while the lower portion of the side panels is substantially perpendicular, thus causing the side panels to also generally follow the shape of adjacent bottles. This is also consistent with the fact that the width of the top panel is slightly less than the width of the bottom panel. The short sloped side panel portions assist in allowing the side panels to closely follow the contour of adjacent bottles. These relationships are illustrated further in FIG. 7.

It will be appreciated that the change in geometry from the continuous path of the lower glue flap extension 22 to the angularly folded glue flaps 78 and bevel panels 24 would normally create stresses which would mitigate against a smooth transition between the two end panel areas. To prevent this from occurring, the cutout 66 and the score lines 68 and 70 allow the glue flaps to fold or flex in this area. By providing cutouts, the length of the fold lines 68 and 70 is reduced, thereby offering less resistance to the flexing of the glue flaps. In addition to providing this function, the cutouts also allow the upper glue flaps 78 to better follow the contour of the shoulder of adjacent bottles, with the edges of the cutouts providing a "bite" to more readily grip and hold the bottles in place.

Figure 9:
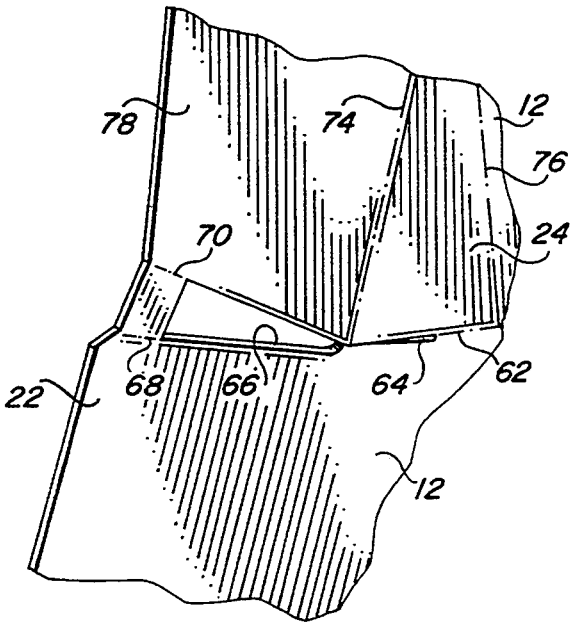
FIG. 9 is an enlarged partial pictorial view of upper and lower glue flaps during movement toward their closed position.

The function of the slits 64 is best understood by referring to FIGS. 5, 6 and 9. When the lower end flap 20 is folded down to cause the gusset tabs to pull the glue flaps into place, the lower glue flaps 22, being closer to the gusset tabs 46, are pulled with more force than the upper glue flaps 78. Also, the lower glue flaps are not connected to fold lines, as are the bevel panels, and therefore provide more resistance to this movement than do the bevel panels. Thus the transition area between the lower glue flaps 22 and the bevel panels 24 tends to buckle or fold as a result of these different stress levels. The slits 64 relieve these stresses by allowing the lower glue flaps 22 initially to be pulled by the gusset tabs to a greater extent than the bevel panels. This can be seen in FIG. 9, which illustrates the upper and lower glue flaps as they are being pulled into closed position. The upper portion of the lower glue flap 22 adjacent the cutout 66 and the upper portion of the side panel 12 immediately beneath the slit 64 are shown as being pulled out of the plane of the upper glue flap 78 and the bevel panel 24, respectively, by the closing stresses. After the glue flaps are in place the folding and securing of the end panel flaps to their final position pushes the material on opposite sides of the slit 64 substantially back into their original planar condition, as the end panel folding stresses are no longer present.

It should be understood that the particular shape and location of the cutouts are functions of the contour of the packaged bottles, and as such may be different than as illustrated in the drawing. Although the presence of cutouts is preferred when the bottles have shoulder portions that can readily extend through the cutouts, cutouts are not essential when a tight closure can be obtained without them. The presence of the slits 64, however, is preferred in all cases in order to assure a smooth end panel forming operation which does not damage or mar the appearance of the carrier. It is also preferred in all cases that the score lines 68 and 70 be provided to allow the transition area between the upper and lower end glue flaps 78 and 22 to flex as necessary during the folding process. If cutouts are not present the slits 64 would be made longer so as to extend out to meet the score lines 68 and 70.

The carrier has been illustrated as being designed to hold twelve beverage bottles arranged in three rows containing four bottles each. The invention is not restricted to carriers designed to hold any particular number of bottles or other articles but would apply to any carrier containing curved articles at the corners. Other features unrelated to the details of the invention may be included in the carrier depending on its size and content, such as, for example, a reinforcing strip between the handle openings and a tear strip to facilitate removing articles from the carrier.

It will be appreciated that the invention provides for automatic closing of the glue flaps as a result of the pivoting movement of the end panel flaps, which is made possible by the gusset tabs that connect the lower end panel flaps to the glue flaps. The unique arrangement of upper and lower glue flaps allows the corner areas of the carrier to engage the corner articles and also provides for engagement of the end panels with the tapered portions of adjacent articles.

It should now be apparent that the invention is not necessarily limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A sleeve-type carrier for packaging a plurality of articles having lower curved portions and upper narrower portions, comprising:

top and bottom panels connected to side panels along fold lines to form a sleeve configuration;

an end panel at each end of the sleeve;

each end panel being comprised of upper and lower end panel flaps connected by fold lines to the top and bottom panels, respectively, the end panel flaps being adhered to upper and lower glue flaps extending transversely from the side panels;

the upper glue flaps being foldably connected to the side panels and the lower glue flaps being an integral extension of the side panel; and each lower end panel flap being connected on either side thereof to the adjacent lower glue flap by a gusset tab, the tab being connected to the lower glue flap by a first tab fold line and to the lower end panel flap by a second tab fold line;

portions of the lower glue flaps being curved to follow the contour of the lower curved portions of articles packaged in the carrier.

2. A sleeve-type carrier according to claim 1, including a bevel panel between each upper glue flap and the associated side panel, each bevel panel being connected by a fold line to the side panel and a fold line to the upper glue flap.

3. A sleeve-type carrier according to claim 2, wherein the fold lines of the bevel panels are angled toward the top panel of the carrier, the bevel panel having a relatively wide lower extremity terminating between the top and bottom panels.

4. A sleeve-type carrier according to claim 3, wherein each side panel includes a score line extending between the lower extremities of associated bevel panels.

5. A sleeve-type carrier according to claim 3, wherein the lower extremity of the bevel panels is at least partially separated from the associated side panel by a slit.

6. A sleeve-type carrier according to claim 5, wherein the slit extends to the fold line connecting the associated bevel panel to the adjacent upper glue flap.

7. A sleeve-type carrier according to claim 1, wherein the gusset tabs are located between the lower end flap and the adjacent lower glue flap, each tab being folded about its second tab fold line so as to be in face-to-face relationship with the interior face of the lower end panel flap, and about its first fold line so as to be in face-to-face relationship with the exterior face of the associated lower glue flap.

8. A sleeve-type carrier according to claim 1, wherein each upper glue flap includes an opening therein at a location corresponding to the intended location of a shoulder of an adjacent packaged article.

9. A sleeve-type carrier according to claim 8, wherein the opening corresponds to the intended location of the top of the barrel portion of a necked bottle.

10. A sleeve-type carrier according to claim 8, including at least one easily foldable line extending from the opening toward an end edge of the upper glue flap.

11. A sleeve-type carrier according to claim 8, wherein the lower extremity of the bevel panels is at least partially separated from the associated side panel by a slit which extends to the associated opening.

12. A sleeve-type carrier according to claim 1, wherein the lower end panel flap fold line has a length less than the width of the bottom panel.

13. A sleeve-type carrier according to claim 12, wherein the carrier is generally rectilinear in shape, the length and width of the bottom panel being greater than the length and width of the top panel.

14. A sleeve-type carrier according to claim 13, wherein the side panels include short sloped portions, the top panel being connected to the short sloped side panel portions.

15. A sleeve-type carrier according to claim 1, wherein the bottom panel has rounded corners substantially corresponding to the curvature of the adjacent curved portions of the lower glue flaps.

16. A blank for forming a sleeve-type carrier for use in packaging a plurality of articles having lower curved portions and upper narrower portions, comprising:

a bottom panel section connected by fold lines to side panel sections;

one of the side panel sections being connected by a fold line to a top panel section;

lower end panel flaps connected by fold lines to opposite ends of the bottom panel section;

upper end panel flaps connected by fold lines to opposite ends of the top panel section;

upper and lower glue flaps extending outwardly of the side panel sections, each upper glue flap being situated between an associated upper end panel flap and an associated lower glue flap and each lower glue flap being situated between an associated lower end panel flap and an associated upper glue flap;

the upper and lower glue flaps being separate from and unconnected directly to the associated upper and lower end panel flaps;

each upper glue flap being connected to an associated lower glue flap;

each lower glue flap being an integral extension of a lower portion of the associated side panel section with no connecting fold line therebetween;

each lower end panel flap being connected on either side thereof to the adjacent lower glue flap by a gusset tab, the tab being connected to said lower glue flap by a first tab fold line and to the lower end panel flap by a second tab fold line, the gusset tabs being located in a carrier formed from the blank between the lower end flap and the adjacent glue flap and being folded about their second tab fold line so as to be in face-to-face relationship with the interior face of the lower end panel flap and about their first fold line so as to be in face-to-face relationship with the exterior face of the associated glue flap; and portions of the lower glue flaps being curved in a carrier formed from the blank to follow the contour of the lower curved portions of articles packaged in the carrier.

17. A carrier blank according to claim 16, including a bevel panel between each upper glue flap and the associated side panel section, each bevel panel being connected by a fold line to the side panel and a fold line to the upper glue flap.

18. A carrier blank according to claim 17, wherein the fold lines of the bevel panels are angled toward the top panel of the carrier, the bevel panel having a relatively wide lower extremity terminating between the top and bottom panel sections.

19. A carrier blank according to claim 18, wherein each side panel section includes a score line extending between the lower extremities of associated bevel panels.

20. A carrier blank according to claim 18, wherein the lower extremity of the bevel panels is at least partially separated from the associated side panel section by a slit, the slit extending to the fold line connecting the associated bevel panel to the adjacent upper glue flap.

21. A carrier blank according to claim 16, wherein each upper glue flap includes an opening therein at a location corresponding to the intended location of a shoulder of an adjacent packaged article, the upper glue flap including at least one easily foldable line extending from the opening toward an end edge of the upper glue flap.

22. A carrier blank according to claim 21, wherein the lower extremity of the bevel panels is at least partially separated from the associated side panel by a slit which extends to the associated opening.

* * * * *